United States Patent [19]

Bailey

[11] 3,930,907

[45] Jan. 6, 1976

[54] HIGH STRENGTH DUCTILE HOT ROLLED NITROGENIZED STEEL

[75] Inventor: Donald J. Bailey, Bloomfield Hills, Mich.

[73] Assignee: General Motors Corporation, Detroit, Mich.

[22] Filed: Dec. 2, 1974

[21] Appl. No.: 529,009

[52] U.S. Cl. ..... 148/12.3; 148/12 F

[51] Int. Cl.[2] ..... C21D 6/02; C21D 9/46

[58] Field of Search ..... 148/12 F, 12.3

[56] References Cited

UNITED STATES PATENTS

| | | | |
|---|---|---|---|
| 3,330,705 | 7/1967 | Madrzyk et al. | 148/12 F |
| 3,625,780 | 12/1971 | Bosch et al. | 148/12.3 |
| 3,788,903 | 1/1974 | Suzuki et al. | 148/12.3 |

*Primary Examiner*—W. Stallard
*Attorney, Agent, or Firm*—Peter P. Kozak

[57] ABSTRACT

Aging hot rolled nitrogenized low carbon steel is treated to produce a material having a level of ductility during forming and a yield strength after forming which is comparable to the 80,000 psi yield strength hot rolled low alloy (HSLA) steels. The method includes the steps of (1) rapidly heating the steel within the alpha plus gamma region of the appropriate phase diagram for the steel and quenching; (2) tempering for example at about 400°F. for about 2 minutes and cooling; (3) deforming at least 2 percent, and (4) aging to develop the 80,000 psi yield strength.

5 Claims, 4 Drawing Figures

HIGH STRENGTH DUCTILE HOT ROLLED NITROGENIZED STEEL

BACKGROUND OF THE INVENTION

This invention relates to a method of treating hot rolled nitrogenized low carbon steel which produces a material having a ductility during forming and a yield strength thereafter comparable to that of the commercial hot rolled 80,000 psi yield strength low alloy (HSLA) steels.

The need to reduce the weight of the automobile has become increasingly urgent in recent years with the need to otherwise accommodate weight increases due to additions of safety and emission control devices and to improve engine performance and fuel economy. These considerations have prompted interest in automobile structural materials having a higher strength-to-weight ratio.

One group of such materials presently being considered is the family of the aforementioned high strength low alloy steels with yield strengths in the neighborhood of 80,000 psi. These steels offer an attractive combination of increased strength and acceptable formability.

The high yield strength of the HSLA steel is developed through a controlled combination of grain refinement, precipitation hardening, and solid solution strengthening which results from the addition of titanium, vanadium or niobium to the basic low carbon steel chemistry, and from the carefully controlled cooling in the hot strip mill in which such steels are produced. Often rare earth alloying elements are added to control the shape of the inclusions and hence to improve the steel's formability. Present steel mill processing limitations require hot rolled steels to be used for stampings having thicknesses of 0.070 inch or more. Many automobile components require thicknesses of 0.08 inch or more such as bumper reinforcements and frame components which must be made of hot rolled steel.

The term "low carbon steel" as used herein is a steel containing up to 0.25 percent carbon and only residual amounts of elements other than those required for deoxidation, particularly silicon 0.6 percent or less, and manganese 1.65 percent or less. The term "nitrogenized steel" as used herein is a "low carbon steel" containing nitrogen preferably in the range of 80 to 200 parts per million or 0.008 to 0.02 percent by weight.

SUMMARY OF THE INVENTION

High strength steels in gauges of 0.070 inch or more are highly desirable for some automotive applications such as bumper reinforcements and frame components which is available only in the form of hot rolled steel and it is the basic object of this invention to provide a method whereby a hot rolled nitrogenized low carbon steel is strengthened to about an 80,000 psi yield strength or more and has satisfactory ductility during forming.

In general, the method is applicable to an aging nitrogenized low carbon hot rolled steel and comprises a first heat treatment followed by a second heat treatment and then a stamping or forming step (prestrain) followed by a third heat treatment. The total added strength of about 20,000 psi provided by the method is the sum of added strength provided by microstructural changes induced metallurgically by the first and second heat treatments, a strength increment due to cold working the steel which involves forming the steel in the high work hardening rate condition created by the first and second heat treatments and finally the strain age strengthening increment caused by subjecting the cold worked part to the third and final heat treatment.

The first and second heat treatments are central to the invention because the first produces a pronounced increase in work hardening rate and the ultimate or tensile strength and the second provides sufficient ductility to form automotive stampings and, at the same time, stabilizes the steel so that these two heat treatments can be accomplished in a steel mill. Accordingly, these first two heat treatments provide the basis for increasing the final strength of the hot rolled nitrogenized low carbon steel to a yield strength of 80,000 psi or more after completion of the third heat treatment. Furthermore, the total elongation, tensile-to-yield ratios, and $n$ value (slope of the natural log true stress vs. natural log true stain plot) of the steel after the first two heat treatments (the condition in which it is formed) provides the steel with a degree of formability as good or better than the best commercial HSLA hot rolled steel available today.

In general, the first heat treatment consists of rapidly heating a sheet of an aging nitrogenized low carbon steel to a temperature within the alpha plus gamma region of the phase diagram for 3–60 seconds and quenching. The second comprises tempering the steel for example, by heating the steel to about 400°F. for about 2 minutes. In the third step, the sheet is press formed to obtain a minimum prestrain of 2 percent. The sheet is then aged at room temperature or for example at temperatures in the vicinity of 400° for a short time to develop a final yield strength of about 80,000 psi.

DESCRIPTION OF THE PREFERRED EMBODIMENTS

The invention will now be described in terms of specific embodiments. A commercial nitrogenized low carbon steel is selected which is basically an SAE 1010 mild steel with about four times the nitrogen content of the standard SAE 1010 steel. Such steel is currently available for example from Inland Steel Company, Great Lakes Steel Company, and Bethlehem Steel Company. These steels have yield strengths in the range of 45,000 to 55,000 psi and are intended for applications where aging at paint curing temper[illegible] (212° – 392°F.) can be used to develo[illegible] strengths of 60,000 psi through strai[illegible]

percent plastic prestrain. The material is relatively fine grained with a ferritic grain size of ASTM 9–11 developed through controlled processing rather than by alloying.

Example Chemical Compositions of Hot Rolled Nitrogenized Low Carbon Steel Heat Treated By This Invention to Produce Steels Having Yield Strengths of 80,000 psi or More are as Follows:

| Sample Code | %C | % Mn | % Ni | %P | % Ti |
|---|---|---|---|---|---|
| GAA-075 | 0.10 | 0.57 | 0.018 | 0.006 | <0.005 |
| GAA-120 | 0.097 | 0.44 | 0.045 | 0.004 | <0.005 |
| INA-090 | 0.071 | 0.53 | 0.019 | 0.007 | <0.005 |
| INA-120 | 0.12 | 0.49 | 0.028 | 0.004 | <0.005 |
| | %V | % Si | % Al | % Cu | % Nb |
| GAA-075 | <0.01 | <0.005 | 0.01 | 0.041 | <0.005 |
| GAA-120 | <0.01 | <0.005 | 0.005 | 0.051 | <0.005 |
| INA-090 | <0.001 | <0.01 | 0.003 | 0.04 | <0.005 |
| INA-120 | <0.001 | <0.01 | 0.001 | 0.028 | <0.005 |
| | %S | % Zr | % Ce | % Mo | % B |
| GAA-075 | 0.018 | <0.005 | <0.01 | <0.01 | <0.005 |
| GAA-120 | 0.017 | <0.005 | <0.01 | 0.015 | <0.005 |
| INA-090 | 0.026 | <0.005 | <0.01 | <0.01 | <0.001 |
| INA-120 | 0.012 | <0.005 | <0.01 | <0.01 | <0.001 |
| | N(ppm) | O(ppm) | | | |
| GAA-075 | 138 | 228 | | | |
| GAA-120 | 82 | 169 | | | |
| INA-090 | 107 | 281 | | | |
| INA-120 | 112 | 190 | | | |

Figure 1:
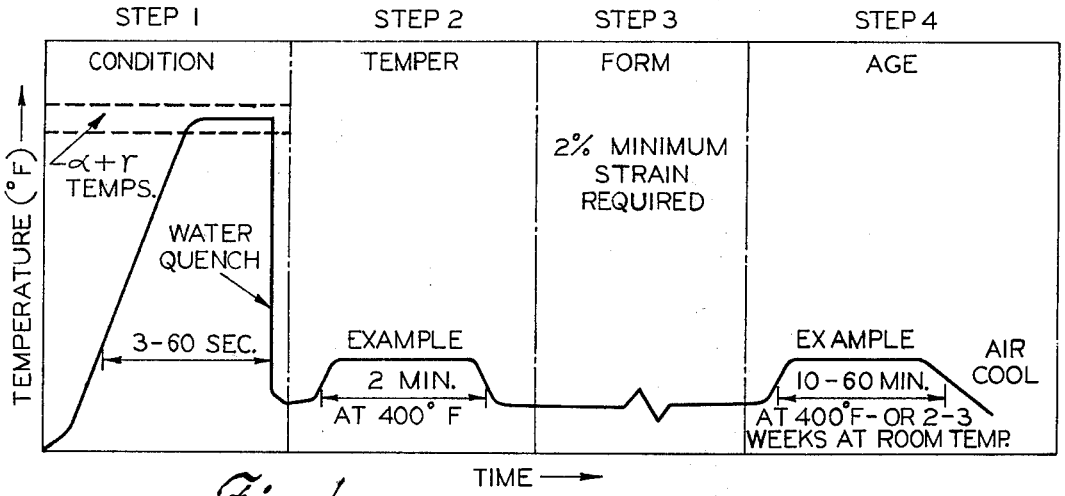
FIG. 1 is a time temperature curve generally depicting the four sequential steps of the invention for increasing the yield strength of hot rolled nitrogenized steel to a minimum of 80,000 psi.

As previously indicated, yield strength of 80,000 or more can be developed in a stamping by means of the method of this invention which consists of the following four essential steps as illustrated in FIG. 1:

1. A first rapid conditioning heat treatment applied to the steel prior to forming comprising heating the sheet rapidly to a temperature within the alpha plus gamma region of the phase diagram, as for example, about 1,400°F. for at least 3 seconds and then quenching;

2. A second heat treatment comprising tempering the steel for example at a temperature of about 400°F. for about 2 minutes to provide the quenched metal with sufficient ductility for subsequent forming without preventing the development of the 80,000 psi final field strength.

3. A prestrain step in which the material is plastically formed by stamping or the like to a strain level of 2 percent or more; and 4. A third heat treatment comprising an aging cycle to obtain the final desired strength, at room temperature for 2 to 3 weeks or for example at about 400°F. for 10 to 60 minutes.

The conditioning first heat treatment is essentially a solution heat treatment designed to take advantage of the large increase in the solubility of carbon and nitrogen in the ferrite near the eutectoid temperature and consists of rapidly heating a sheet of hot rolled aging nitrogenized low carbon steel for example by induction heating to a temperature within the alpha plus gamma transformation region of the appropriate phase diagram for the steel, holding the steel at this temperature for at least 3 seconds and then quenching in brine or water. In principle any temperature within the alpha plus gamma region of the phase diagram would be satisfactory. The particular temperature used and duration of the treatment, however, are selected to dissolve a substantial proportion of the carbon and nitrogen in the ferrite and to form a predetermined proportion of austenite. Upon quenching, a substantial proportion of the solubilized carbon and nitrogen is retained in solution with the ferrite, while a major proportion of the austenite is transformed to martensite and/or bainite. Because the final strength of the steel is dependent upon the specific conditions of each of the four processing steps, while the necessary ductility required for forming is determined only by the first and second heat treatments, the specific time and temperature of the heat treatments are determined by trial and error. In other words, the temperature and duration of the first two heat treatments are determined by the minimum amount of deformation required in the third or forming step, the minimum ductility required for such forming, and by the desired final strength which is developed after the third heat treatment. The time and temperatures of the first two heat treatments are also to some extent affected by the method of heating and quenching used since some methods such as induction heating are more rapid than others.

In general, the first conditioning heat treatment for improving the strength of hot rolled nitrogenized low carbon steel is somewhat higher with the same heating method than for cold rolled nitrogenized steel as described in the copending application Ser. No. 529,010, filed concurrently herewith, and now U.S. Pat. No. 3,928,086 because a higher volume fraction of martensite must be produced in the hot rolled steel to attain the final desired minimum yield strength of 80,000 psi. This is required because of the reduced strain age strengthening which has been observed for hot rolled steel in the aging heat treatment of step 4. Thus, whereas heating to 1,340°F. for about 5 seconds would be adequate for producing 80,000 psi in the cold rolled steel, a temperature of 1,395° may be necessary for the hot rolled steel. With the higher volume fraction of martensite formed, the ductility of the steel following the first heat treatment is insufficient to meet many automotive stamping requirements.

The second heat treatment of the method in step 2 tempers the martensite to produce the required ductility while retaining the majority of the beneficial strengthening effects of the first heat treatment. A change in the distribution of precipitates in the ferrite has been observed which is believed to contribute to the increased ductility of the metal.

The steel is then press formed to obtain a minimum prestrain equivalent to at least 2 percent in tension in step 3 of the method.

Finally in step 4 of the method, the formed steel is aged at room temperature or at paint curing temperature to develop a final yield strength of 80,000 psi.

The first two heat treatments are central to this invention because the first produces a large increase in the work hardening rate and in ultimate or tensile strength of the material, and the second provides sufficient ductility to form automotive stampings and, at the same time, stabilizes the steel so that these two heat treatments could be accomplished in a steel mill as described previously. Accordingly, these two heat treatments provide the basis for increasing the strength of a hot rolled nitrogenized low carbon steel to a yield strength of 80,000 psi or more after completion of the final (fourth) processing step. Furthermore, the total elongation, tensile to yield ratio, and *n* value of the steel after the first two heat treatments (the condition in which it is formed) provide the steel with a degree of formability as good or better than the best of the commercial HSLA hot rolled steels available today.

EXAMPLE I

A hot rolled nitrogenized low carbon steel (GAA-075) is induction heated to a temperature of 1,380° ± 15°F. and quenched in agitated water after about 3 seconds elapsed time, as measured with respect to 1,320°F. by a thermocouple attached to the test piece. The steel is then tempered for 10 minutes in an oil bath at 392° ± 5°F. and cooled in air to room temperature. After tempering, the steel is strained to a tensile elongation of 2 percent and then aged for 60 minutes at 392°F. to produce a final yield strength of at least 80,000 psi.

EXAMPLE II

A hot rolled nitrogenized low carbon steel (GAA-075) is heated by submersion in a liquid salt bath at 1,420°F. for a total of 60 seconds and immediately quenched in brine. The steel is then tempered for 5 minutes in another salt bath at 572°F. and cooled in air to room temperature. After tempering, the steel is strained to a tensile elongation of 2 percent and aged for 60 minutes at 392°F. to produce a final yield strength of at least 80,000 psi.

Figure 2:
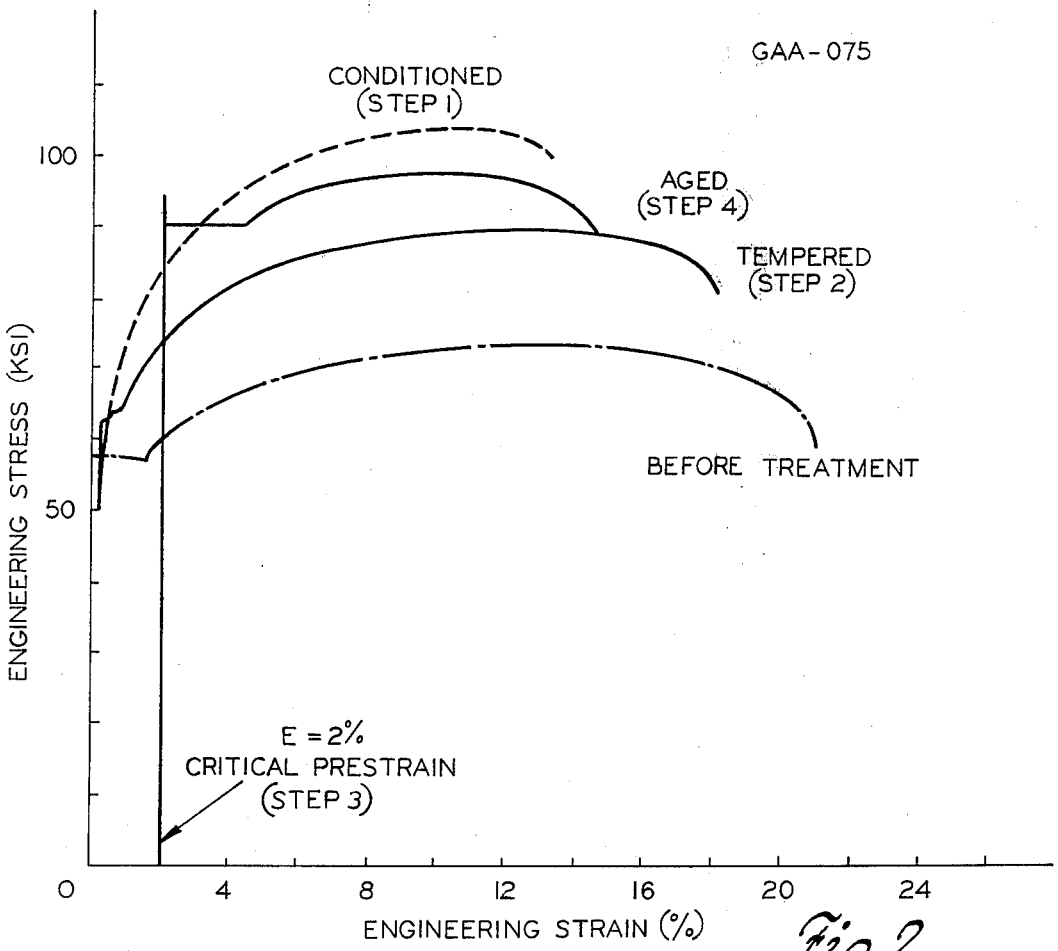
FIG. 2 shows illustrative tensile stress-strain curves for the GAA-075 hot rolled nitrogenized steel after each processing step.

FIG. 2 illustrates the effect of each step of this invention on the tensile stress strain curves of the GAA-075 hot rolled nitrogenized steel treated according to Example I. A curve for the steel before heat treatment is shown for comparison. As shown, the yield stress (defined by 0.2 percent offset stress) is decreased significantly after the first step, while the rate of work hardening and the ultimate tensile strength are markedly increased. The total elongation is less than required for automotive applications, but as a result of the second heat treatment, is increased to a desired minimum value of 18 percent. A slight decrease in ultimate tensile strength and increase in yield stress is also noted after the second heat treatment. After straining in tension to 2 percent elongation and aging at 400°F. for 60 minutes, the steel has a yield strength greater than 80,000 psi as shown.

Figure 3:
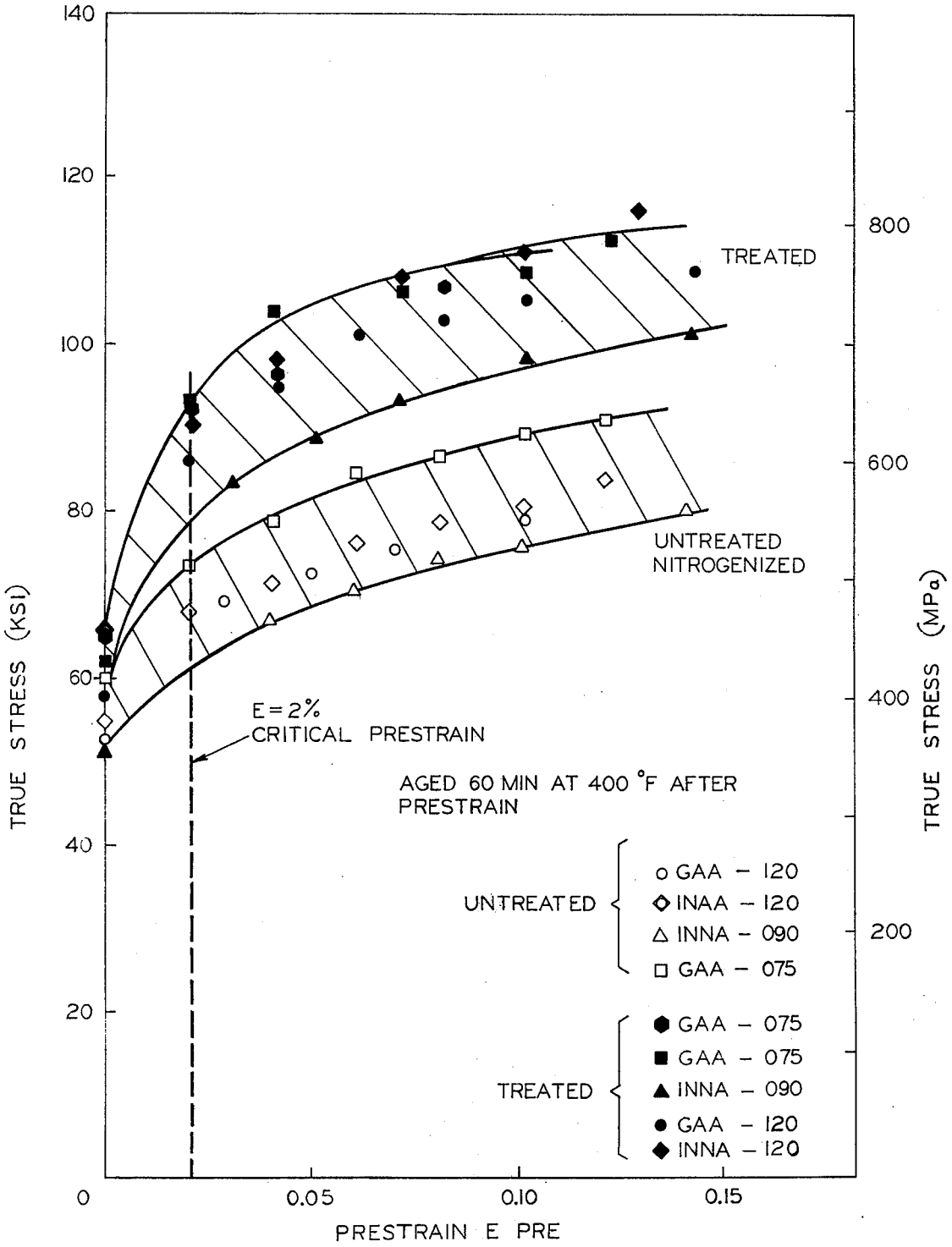
FIG. 3 are true yield stress-prestrain curves showing the dependence of the final strength of hot rolled nitrogenized steel on the amount of plastic strain or the third step of the process. Data for untreated nitrogenized steel is shown for comparison.

The relationship of the amount of plastic deformation introduced during step 3 to the final strength produced by this invention is shown in FIG. 3. These data are for the aforementioned example hot rolled nitrogenized steels processed according to Example I heat treatments, but with varying amounts of strain in step 3. As shown, a critical strain of about 2 percent is required to obtain a tensile yield strength of 80,000 psi or greater. Higher strains lead to additional strengthening (e.g., yield strengths in excess of 100,000 psi with a strain of 14 percent).

Figure 4:
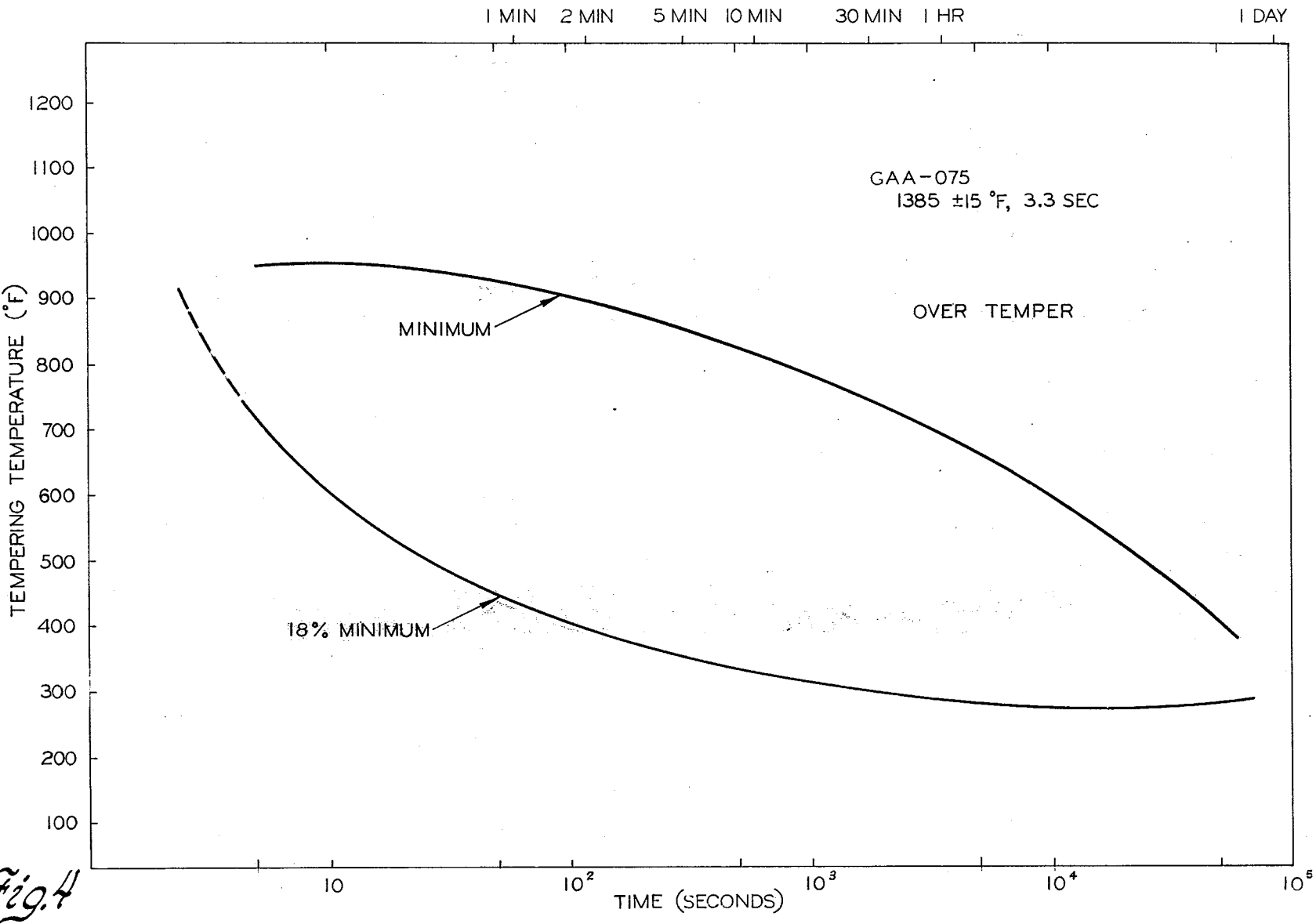
FIG. 4 is a tempering time-temperature diagram for the second heat treatment of the GAA-075 example nitrogenized steel.

A variety of specific tempering heat treatments can be used in step 2 of the method to obtain strengths of at least 80,000 psi as shown in FIG. 4 for the example steel GAA-075). Any combination of tempering times and temperatures within the region defined by these curves is acceptable. The lower curve is defined by the required tensile elongation (ductility) after steps 1 and 2 of at least 18 percent. The upper curve is based on a required final yield strength of at least 80,000 psi when strained 2 percent during step 3. Curves for the other example steels vary somewhat but are similar. Of considerable practical importance is the applicability of a short term high temperature temper (e.g. 5 seconds at about 840°F), since this is most compatible with a high speed continuous production process. Further, such a temper is consistent with the thermal cycle of a continuous hot dip galvanizing line in a steel mill. Thus, this invention provides an economical means of producing a high strength hot dipped galvanized steel for improved corrosion protection, with acceptable formability for high strength automotive stampings.

Similar results are obtained with cold rolled nitrogenized low carbon steel, with the principle advantage over the 3 step process of the copending application Ser. No. 529,010, being the metallurgical stability of the material after the tempering or second step which makes it more applicable to steel mill production practices.

The method of this invention is advantageous over that disclosed in the aforementioned application Ser. No. 529,010 in the following respects.

Yield strengths of at least 80,000 psi can be produced in hot rolled nitrogenized low carbon steel at a level of ductility sufficient to be of use for automotive stampings. The maximum yield strength obtained with the aforesaid process of Ser. No. 529,010 was 70,000 to 73,000 psi when applied to hot rolled steel when subject to the same ductility requirement. The metallurgical microstructure of the steel becomes relatively stable after the first two heat treatments. Thus the treated steel does not have to be formed within 3–5 days of the initial heat treatments in order to retain maximum ductility for stamping as is recommended with the method of the copending application. Accordingly, the first two heat treatments may be performed at the steel mill and the third and fourth steps may be performed by the purchasers and fabricators of the steel sheet. In the aforesaid copending method it is necessary to install processing equipment in close proximity to a press plant so as to heat treat the steel just prior to stamping.

The hot rolled nitrogenized steel treated by the method of this invention is advantageous over the 80,000 psi hot rolled HSLA steels in that it is less expensive, offering at present prices a potential savings of approximately $2.50/cwt over the price of HSLA steel, requires no expensive alloying additions such as V, Ti, Nb and Zr, and is thus ecologically more efficient than HSLA steel, requires lower press loads during stamping, and has superior residual ductility after strain aging (e.g., samples prestrained 10 percent and aged 60 minutes at 392°F. show 8–11 percent additional strain to failure as compared to 2–4 percent for HSLA steel (Van-80)).

The method of this invention may also be applied to low carbon steels generally to markedly improve the strength of such steels, and although this invention has been described in terms of specific embodiments, it is obvious that variations may be adapted within the scope of this invention.

What is claimed is:

1. The method of producing a high yield strength steel comprising the steps of:

heating an aging low carbon steel to a temperature within the alpha plus gamma region of the iron carbon phase diagram for a time sufficient to dissolve a substantial proportion of the carbon into the ferrite of said steel and to form a predetermined proportion of said steel into austenite, quenching said steel to substantially retain the solubilized carbon in solution and to transform at least the major proportion of said austenite into a form selected from the group consisting of martensite and bainite, tempering said steel, plastically deforming the steel an amount equivalent to at least 2 percent on the tensile stress-strain diagram, aging said deformed steel for time sufficient to develop a desired superior yield strength, said predetermined proportion of austenite being an amount necessary to provide the aged steel with said yield strength when said steel is deformed at least the equivalent of 2 percent on the tensile stress-strain diagram, said temper providing the said quenched steel with sufficient ductility for subsequent forming without preventing the development of said desired yield strength.

2. The method of producing a high yield strength nitrogenized low carbon steel comprising the steps of:

rapidly heating an aging low carbon nitrogenized steel to a temperature within the alpha plus gamma region of the phase diagram for a time sufficient to dissolve a substantial proportion of the carbon and nitrogen into the ferrite of said steel and to form a predetermined proportion of said steel into austenite, quenching said steel to substantially retain the solubilized carbon and nitrogen in solution and to transform at least the major proportion of said austenite into a form selected from the group consisting of martensite and bainite, tempering said quenched steel, plastically deforming the steel an amount equivalent to at least 2 percent on the tensile stress-strain diagram, aging said deformed steel for a time sufficient to develop a minimum yield strength of 80,000 psi, said predetermined proportion of austenite being an amount necessary to provide the aged steel with the yield strength of about 80,000 psi when said steel is deformed at least the equivalent of 2 percent on the tensile stress-strain diagram, said temper providing said quenched steel with sufficient ductility for subsequent forming without preventing the development of said minimum yield strength.

3. The method of producing a high yield strength nitrogenized low carbon steel comprising the steps of:

rapidly heating a hot rolled aging low carbon nitrogenized steel to a temperature within the alpha plus gamma region of the phase diagram for a time sufficient to dissolve a substantial proportion of the carbon and nitrogen into the ferrite of said steel and to form a predetermined proportion of said steel into austenite, quenching said steel to substantially retain the solubilized carbon and nitrogen in solution and to transform at least the major proportion of said austenite into a form selected from a group consisting of martensite and bainite, tempering said quenched steel, plastically deforming the steel an amount equivalent to at least 2 percent on the tensile stress-strain diagram, aging said deformed steel for a time sufficient to develop a minimum yield strength of 80,000 psi, said predetermined proportion of austenite being an amount necessary to provide the aged steel with a yield strength of about 80,000 psi when said steel is deformed at least the equivalent of 2 percent on the tensile stress-strain diagram, said temper providing said quenched steel with sufficient ductility for subsequent forming without preventing the development of said minimum yield strength.

4. The method of producing a high yield strength nitrogenized low carbon hot rolled steel comprising the steps of:

rapidly heating an aging low carbon steel to a temperature within the alpha plus gamma region of the iron carbon phase diagram in the range of about 1,319° to 1,420°F. for a time sufficient to dissolve a substantial proportion of the carbon and nitrogen into the ferrite of said steel and to form a predetermined proportion of said steel into austenite, quenching said steel to substantially retain the solubilized carbon and nitrogen in solution and to transform at least the major proportion of said austenite into a form selected from the group consisting of martensite and bainite, tempering said quenched steel, plastically deforming the steel an amount equivalent to at least 2 percent on the tensile stress-strain diagram, aging said deformed steel for time sufficient to develop a minimum yield strength of 80,000 psi, said predetermined proportion of austenite being an amount necessary to provide the aged steel with the yield strength of about 80,000 psi when said steel is deformed at least the equivalent of 2 percent on the tensile stress-strain diagram, said temper providing said quenched steel with sufficient ductility for subsequent forming without preventing the development of said minimum yield strength.

5. The method of producing a high yield strength nitrogenized low carbon hot rolled steel comprising the steps of:

rapidly heating an aging low carbon steel to a temperature within the alpha plus gamma region of the iron carbon phase diagram in the range of about 1,319° to 1,420°F. for a time period of 3 to 60 seconds to dissolve a substantial proportion of the carbon and nitrogen into the ferrite of said steel and to form a predetermined proportion of said steel into austenite, quenching said steel to substantially retain the solubilized carbon and nitrogen in solution and to transform at least the major proportion of said austenite into a form selected from the group consisting of martensite and bainite, tempering said quenched steel, plastically deforming the steel an amount equivalent to at least 2 percent on the tensile stress-strain diagram, aging said deformed steel for time sufficient to develop a minimum yield strength of 80,000 psi, said predetermined proportion of austenite being an amount necessary to provide the aged steel with the yield strength of at least about 80,000 psi when said steel is deformed at least the equivalent of 2 percent on the tensile stress-strain diagram, said temper being such as to provide the quenched steel with sufficient ductility to permit a tensile deformation of about 18 percent without preventing the development of the said 80,000 psi final yield strength.

* * * * *